US005402040A

United States Patent [19]

Sprout

[11] Patent Number: 5,402,040

[45] Date of Patent: Mar. 28, 1995

[54] DIMMABLE BALLAST CONTROL CIRCUIT

[75] Inventor: James C. Sprout, Los Altos, Calif.

[73] Assignee: The Watt Stopper, Santa Clara, Calif.

[21] Appl. No.: 156,492

[22] Filed: Nov. 23, 1993

[51] Int. Cl.[6] ..... H05B 37/02

[52] U.S. Cl. ..... 315/157; 315/156; 315/158; 315/149; 315/291; 315/DIG. 4

[58] Field of Search ..... 315/157, 158, 156, 291, 315/149, DIG. 4, 159, 150

[56] References Cited

U.S. PATENT DOCUMENTS

| | | | |
|---|---|---|---|
| 3,999,100 | 12/1976 | Dendy et al. | 315/308 |
| 4,016,451 | 4/1977 | Engel | 315/158 |
| 4,249,160 | 2/1981 | Chilvers | 340/33 |
| 4,628,230 | 12/1986 | Krokaugger | 315/307 |

OTHER PUBLICATIONS

Instructions for installation and diagram of circuit believed to be used in the Celestial Sensor manufactured by MultiPoint Lighting Control Systems.

*Primary Examiner*—Robert J. Pascal
*Assistant Examiner*—Reginald A. Ratliff
*Attorney, Agent, or Firm*—Townsend and Townsend Khourie and Crew

[57] ABSTRACT

A control circuit for controlling the light output level of a dimmable fluorescent light ballast such as the Mark VII ballast manufactured by Advance Transformer, Inc. The circuit operates from power supplied by the Mark VII ballast through a 300 to 500 microamp DC current loop. The control circuit includes a photo sensor that detects the level of ambient light in a room, and in response to the detected light level, the circuit sets a voltage level from 2 and 10 volts between the two output leads for the current loop on the ballast. At 2 volts, the light is at its dimmest level, which is 20 percent of its maximum brightness, while at 10 volts, the light is at the 100 percent level. Between 2 and 10 volts, the light's brightness is set on a linear scale between 20 and 100 percent.

11 Claims, 1 Drawing Sheet

DIMMABLE BALLAST CONTROL CIRCUIT

BACKGROUND OF THE INVENTION

The present invention relates to a circuit that controls the brightness of a light. More specifically, the present invention pertains to a circuit that controls the brightness of a light connected to a dimmable electronic ballast such as the Mark VII Fluorescent Lamp Ballast manufactured by Advance Transformer Company.

The Mark VII Fluorescent Lamp Ballast provides a pair of output leads through which it supplies a DC current loop of between 300 and 500 microamps. To control the intensity level of a light connected to the Mark VII ballast, the voltage level between these two leads is adjusted between 2 and 10 volts. At 2 volts, the light connected to the ballast is at its minimum output of 20 percent. While at 10 volts, the light is operating at the 100 percent level.

It is desirable: to control the brightness of lights connected to the Mark VII ballast in response to the level of ambient light in an area or room. When the ambient light level is low, the lights can be operated at their 100 percent output level to provide maximum lighting for the room, and when the ambient light level is high, the Mark VII ballast can dim the output of the lights to save electricity.

A known prior art circuit manufactured by Multipoint Lighting Control Systems controls the brightness of lights connected to the Mark VII ballast using a reversed-biased photo sensor to detect the ambient light level in a room. Reverse-biasing a photo sensor, however, results in a nonlinear response to the detected light level. Thus, the Multipoint circuit cannot control the Mark VII ballast in a manner such that the ballast accurately maintains a constant light level in a room.

Additionally, in determining the brightness level of the light connected to the ballast, the Multipoint circuit compares the output of the photo detector after it has been amplified by a transistor to a reference voltage created by the voltage drop across a base and emitter of a transistor that can vary significantly with the temperature. Using an unstable voltage as a reference voltage also detracts from the control circuits ability to accurately maintain a constant light level in a room.

SUMMARY OF THE INVENTION

The present invention provides a control circuit for the Mark VII ballast that can accurately increase and decrease the brightness of lights in response to a detected level of ambient light to maintain a constant light level in a room. The control circuit derives power from the 300 to 500 microamp DC current loop supplied by the ballast's two output leads.

The circuit includes a zero-biased photo sensor that detects the level of ambient light in a room and can provide a linear output response to the detected light level, a reference diode that sets a precision reference voltage level so that the control of the Mark VII ballast is independent of temperature, a pair of operational amplifiers that amplify the detected light level and compare it to the reference voltage level, respectively, a Darlington transistor that limits the current pulled through the operational amplifier and amplifies the difference in the light level and reference level voltages allowing up to 100 ballasts to be controlled by a single control circuit, and a zener diode that limits the voltage across the two output leads and protects the circuit from damage if it is reverse connected.

The circuit sets the voltage level between the two output leads in a range between 1.7 and 12 volts to control the brightness of lights connected to the ballast. At 2 volts or below, lights are at their dimmest level, which is 20 percent of their maximum brightness, while at 10 volts or above, lights are set at the 100 percent level. Between 2 and 10 volts, the brightness of a light is set on a linear scale between 20 and 100 percent.

The control circuit of the present invention allows a user to adjust the brightness level of the light or lights connected to the Mark VII ballast at the sensor or at a remote location connected to the sensor by low-voltage wiring. The control circuit also allows a user to adjust the response time in which the circuit effects changes to the light level. Additionally, and of prime importance, the disclosed control circuit accomplishes all of this in an inexpensive manner when manufactured on a large scale.

DESCRIPTION OF THE PREFERRED EMBODIMENT

Figure 1:
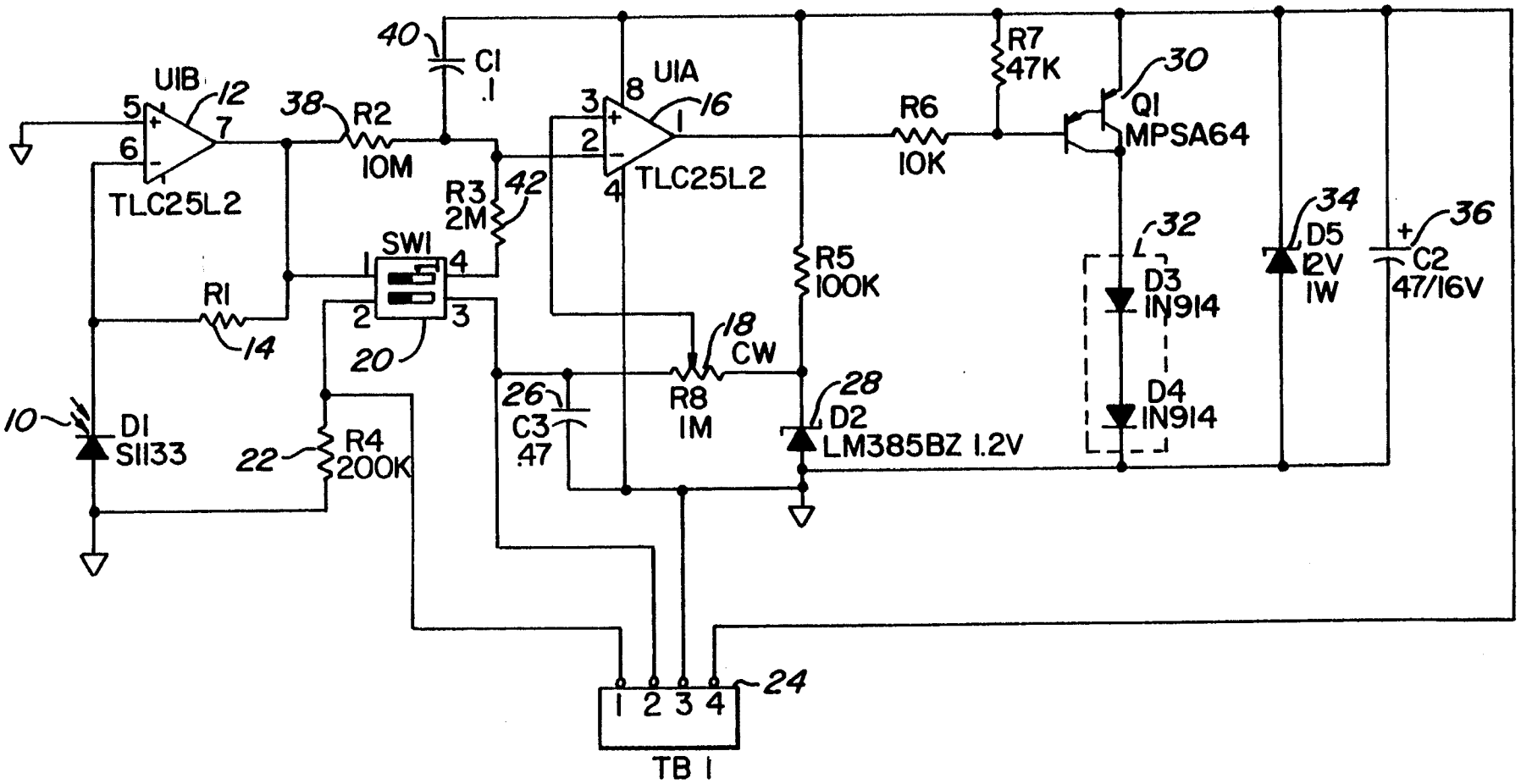
FIG. 1 is a detailed schematic diagram of the dimmable ballast control circuit according to the present invention.

FIG. 1 is a detailed schematic diagram of the dimmable ballast control circuit according to the present invention. In FIG. 1, a photo sensor 10 detects the light level in a room through a lens which is not shown. The lens is set so that the field of view for the sensor is about 45 degrees. Thus, if the lens is mounted on an 8-foot-high ceiling, photo sensor 10 will detect light within a cone having a diameter of a little more than 6.5 feet at the floor. Light outside of this cone will not be detected by the photosensor. In one embodiment, the lens can be moved closer to and further from photo sensor 10 to increase and decrease the sensor's field of view.

The output of photo sensor 10 is coupled to the summing junction of an operational amplifier 12, which has its reference junction coupled to a ground potential. The gain of operational amplifier 12 is set by a resistor 14, coupled between the negative input and output of operational amplifier 12. Using operational amplifier 12, with its reference junction zero biased, to amplify the output of photo sensor 10 results in a linear output of amplifier 12 in response to the detected light level.

The amplified detected light level is output from operational amplifier 12 to the summing junction of operational amplifier 16. To minimize costs, the preferred embodiment uses a single chip (TLC25L2 manufactured by Texas Instruments) having dual low-voltage CMOS operational amplifiers which can operate on as little as 1.4 volts of energy to implement operational amplifier 12 and operational amplifier 16. The reference junction of operational amplifier 16 is coupled to the wiper of a potentiometer 18. Thus, operational amplifier 16 outputs the difference between the reference voltage set at its reference junction and the signal output from operational amplifier 12.

Potentiometer 18 controls the brightness range in which the dimmable ballast can operate lights connected to it by adjusting the voltage at the reference junction of operational amplifier 16. When potentiometer 18 is set to its maximum level, the voltage at the reference junction is at its lowest level and the controlled light can be adjusted anywhere from 20 to 100 percent output. When potentiometer 18 is set to minimum resistance, the voltage level at the reference junction is at its greatest level and the intensity of the controlled light can only be adjusted along a small range.

A switch 20 allows for a remote potentiometer to control the range at which the Mark VII ballast can set a light. Switch 20 comprises two separate switches, one of which couples potentiometer 18 to a ground potential through a resistor 22 or to a remote potentiometer, not shown, through input pins 1 and 2 of a cable connector 24. Of course, a person skilled in the art will recognize other methods of implementing switch 20. For example, either a jumper or simply cutting the connecting wire and twisting it back together can be used to function as each separate switch in switch 20.

The remote potentiometer is coupled to pins 1 and 2 of a cable connector 24 by low voltage wiring. In order for the remote potentiometer to maximize its control of the light, potentiometer 18 should be set to its minimum level. If potentiometer 18 is set to the 50 percent level, the remote potentiometer can only control approximately 50 percent of the light's output range, and if potentiometer 18 is set to its maximum level, the remote potentiometer will have almost no effect on the circuit. Capacitor 26 limits noise on the line connecting the remote potentiometer.

Current from the dimmable ballast is supplied to the control circuit through pins 3 and 4 of cable connector 24. Pin 3 is coupled directly to a ground potential, and the potential at pin 4 is proportional to the gain of operational amplifier 16. Thus, the potential between pins 3 and 4 is set by the control circuit to control the brightness of lights connected to the dimmable ballast. Additionally, operational amplifiers 12 and 16 derive their power from the voltage potential between pins 3 and 4, making the signal terminals and the supply terminals of the control circuit of the present invention one and the same.

Reference diode 28 is coupled to potentiometer 18 and, depending on the setting of potentiometer 18, sets the voltage at the reference junction of operational amplifier 16 from between 1.2 volts to 0.2 volts. The output of operational amplifier 16 is coupled to the base of a Darlington PNP transistor 30. Darlington transistor 30 amplifies the output so that up to 100 ballasts can be controlled by the control circuit. The emitter of Darlington transistor 30 is coupled to pin 4 of connector 24, and the collector is coupled to a pair of diodes 32. Diodes 32 ensure that the potential between pins 3 and 4 does not drop below 1.7 volts, and thus ensure that operational amplifiers 12 and 16 always have a large enough power supply to operate correctly.

Also directly coupled between pins 3 and 4 are a zener diode 34 and a large capacitor 36. Zener diode 34 is a 12-volt zener which ensures that the voltage between pins 3 and 4 does not increase above 12 volts and prevents damage to the circuit if it is reverse connected. Capacitor 36 reduces noise between the pins.

The time it takes the control circuit to respond to changes in the detected light level is determined by the RC constant of operational amplifier 16. When the second switch of switch 20 is open, the RC constant is set by a resistor 38 and a capacitor 40. In one embodiment, resistor 38 is a 10 million ohm resistor while capacitor 40 is a 0.1 farad capacitor. These values provide a response time of about 10 seconds. Thus, it takes the control circuit about 10 seconds to brighten the lights when photo sensor 10 detects less ambient light in its field of view. This ensures that the control circuit will not adjust the lighting of the Mark VII ballast if the photo sensor is temporarily blocked by an object.

A second switch of switch 20 is used to reduce the RC constant by closing the switch to couple a resistor 42 (2 million ohms) in parallel with resistor 38, thus making the circuit react quicker to light changes. When the second switch of switch 20 is closed, the circuit has a response time of about 2 seconds. Of course, a person skilled in the art will recognize that additional resistors can be switched in and out to provide more than two response times to select from, or that changing the capacitance of the circuit, rather than the resistance, can be done to change the time constant. Additionally, rather than switch resistor 42 in and out of the circuit, it is possible to hard-wire resistor 42 in and cut the wire to switch it out of the circuit.

Having fully described one embodiment of the present invention, many other equivalent or alternative methods of implementing the present sensor will be apparent to those skilled in the art. These equivalents and alternatives are intended to be included within the scope of the present invention.

What is claimed is:

1. A circuit for controlling the brightness of a light coupled to a dimmable electronic ballast, said circuit comprising:

a photodiode for detecting an ambient light level and producing a first voltage level in response to said detected light level;

a first amplifier for amplifying said first voltage level, said first amplifier having a first summing junction coupled to said photodiode and a first reference junction coupled to a ground potential;

a reference diode for producing a reference voltage level;

a second amplifier for outputting the difference between said first voltage level and said reference voltage level, said second amplifier having a second summing junction coupled to said output of said first amplifier and a second reference junction coupled to said reference diode; and a Darlington transistor pair, coupled at a base to an output of said second amplifier, at an emitter to the dimmable ballast, and at a collector to a ground potential, for amplifying the output: of said second amplifier and producing a second voltage level between said emitter and said ground potential;

whereby the brightness of the light is set by the dimmable ballast in response to said second voltage level.

2. The circuit set forth in claim 1 further comprising a zener diode, coupled in parallel with said Darlington transistor pair between said emitter and said ground potential, for limiting said second voltage level.

3. The circuit set forth in claim 2 wherein said zener diode limits said second voltage level to about 12 volts.

4. The circuit set forth in claim 2 further comprising a capacitor, coupled in parallel with said zener diode between said emitter and said ground potential, for limiting noise on said second voltage level.

5. The circuit set forth in claim 4 further comprising a potentiometer, coupled between said reference diode and said second reference junction, for adjusting said reference voltage at said second reference junction.

6. The circuit set forth in claim 5 further comprising a pair of diodes, coupled serially between said collector and said ground potential, for ensuring a minimum voltage level across power supply terminals of said first and second operational amplifiers.

7. The circuit set forth in claim 6 wherein a first output lead from the dimmable ballast is coupled to said emitter and a second output lead from the dimmable ballast is coupled to said ground potential so that said second voltage level is also set between said first and second output leads and wherein current flowing between said two output leads provides power across said power supply terminals.

8. The circuit set forth in claim 7 wherein said minimum voltage level is about 1.7 volts.

9. A circuit for controlling the brightness of a light coupled to a dimmable electronic ballast, said circuit comprising:

a photodiode for detecting a light level and producing a first voltage level in response to said detected light level;

a first amplifier for amplifying said first voltage level, said first amplifier having a first summing junction coupled to said photodiode and a first reference junction coupled to a ground potential;

a first resistor, coupled at a first terminal to the output of said first amplifier;

a first capacitor, coupled to a second terminal of said first resistor to create a first RC time constant;

a reference diode for producing a reference voltage level;

a second amplifier for outputting the difference between said first voltage level and said reference voltage level at a rate determined by said first time constant, said second amplifier having a second summing junction coupled to said second terminal of said first resistor and having a second reference junction;

a potentiometer, coupled to said reference diode and having a wiper coupled to said second reference junction, for adjusting said reference voltage at said second reference junction;

a switch, coupled to said first terminal of said first resistor, for coupling a second resistor in parallel with said first resistor to decrease said time constant and thus increase said rate at which said second amplifier responds to the difference between said first voltage level and said reference voltage level;

a Darlington transistor, coupled at a base to an output of said second amplifier, at an emitter to the dimmable ballast, and at a collector to a ground potential, for amplifying the output of said second amplifier and producing a second voltage level between said emitter and said ground potential;

voltage setting means, including a first diode coupled between said collector and said ground potential and a second diode coupled between said first diode and said ground potential, for ensuring said second voltage level is above about 1.7 volts;

a zener diode, coupled between said emitter and said ground potential in parallel with said Darlington transistor and said voltage setting means, for limiting said second voltage level to about 12 volts; and a second capacitor, coupled in parallel with said zener diode between said emitter and said ground potential, for limiting noise on said second voltage level;

whereby the brightness of the light is set by the dimmable ballast in response to said second voltage level.

10. The circuit set forth in claim 9 wherein said control circuit is encased in a housing member.

11. The circuit set forth in claim 10 wherein said circuit further comprises a second potentiometer outside of said housing member, coupled to said first potentiometer by low voltage wiring, for adjusting said reference voltage at said second summing junction.

* * * * *